US009226604B1

(12) United States Patent
Steele

(10) Patent No.: US 9,226,604 B1
(45) Date of Patent: Jan. 5, 2016

(54) FREE-STANDING, INSULATING ALUMINUM CAN BEVERAGE HOLDER

(71) Applicant: Eric Andrew Steele, Compton, CA (US)

(72) Inventor: Eric Andrew Steele, Compton, CA (US)

( * ) Notice: Subject to any disclaimer, the term of this patent is extended or adjusted under 35 U.S.C. 154(b) by 21 days.

(21) Appl. No.: 13/678,807

(22) Filed: Nov. 16, 2012

(51) Int. Cl.
*A45F 3/44* (2006.01)
*A47F 7/28* (2006.01)

(52) U.S. Cl.
CPC ..... *A47F 7/28* (2013.01)

(58) Field of Classification Search
USPC ..... 248/545, 311.2, 156; 229/403; 220/739
See application file for complete search history.

(56) References Cited

U.S. PATENT DOCUMENTS

| | | | | |
|---|---|---|---|---|
| 4,163,374 | A * | 8/1979 | Moore et al. | 62/457.4 |
| 6,575,417 | B1 * | 6/2003 | Krommenakker | 248/311.2 |
| 6,732,985 | B1 * | 5/2004 | Cantrell | 248/125.1 |
| 2004/0144904 | A1 * | 7/2004 | Carnevali | 248/278.1 |

* cited by examiner

*Primary Examiner* — Bradley Duckworth
(74) *Attorney, Agent, or Firm* — Plager Schack LLP

(57) ABSTRACT

A device for holding a beverage container, such as an aluminum can, may include a holder and a stake. The stake may be driven into the ground to keep the beverage container relatively free from spillage and contamination. The holder may have minimal surface area in contact with the beverage container. The holder may also form an insulating air gap between the beverage container and the inner surface of the holder. The insulating air gap serves to help maintain a temperature of the contents of the beverage container.

5 Claims, 3 Drawing Sheets

FREE-STANDING, INSULATING ALUMINUM CAN BEVERAGE HOLDER

BACKGROUND OF THE PRESENT DISCLOSURE

1. Field of the Present Disclosure

The present disclosure is directed to a device for holding an aluminum can, such as a beverage container or the like. The device may be driven or implanted into the ground and may be free-standing.

2. Related Art

Many modern beverages are packaged in and consumed from aluminum cans. The cans are convenient containers that are frequently used at outdoor gatherings, such as a barbecue, birthday party, picnic, tailgate party, hike, camping trip, or the like. When an aluminum can is placed on the ground or other outdoor surface, it may be contaminated by bugs, dirt, grass, and so on. The can may also be easily spilled, such as kicked over or knocked off a table.

In addition, the aluminum material of the can does not provide high quality insulation for the liquid inside. If the liquid is chilled, e.g., by being stored in a cooler or refrigerator, it may heat rapidly if it is moved to a warmer environment, e.g., outdoors, for consumption. Insulation devices exist, but these do solve the problems of spillage and contamination described above.

SUMMARY OF THE PRESENT DISCLOSURE

The present disclosure provides insulation for an aluminum can while storing the can so that the risk of spillage or contamination may be reduced or substantially eliminated, as well as other advantages apparent from the discussion herein.

According to one aspect of the present disclosure, a device for holding a beverage container above the ground to keep it substantially free from spillage and contamination includes a holder and a stake. The holder is configured to receive a beverage container and to substantially surround the beverage container. The holder is also configured to minimize a surface area contacting the beverage container. The holder is further configured to form an insulating air gap between the beverage container and the holder. The stake is connected to the holder and includes a pointed tip.

Additional features, advantages, and aspects of the present disclosure may be set forth or apparent from consideration of the following detailed description, drawings, and claims. Moreover, it is to be understood that both the foregoing summary of the present disclosure and the following detailed description are exemplary and intended to provide further explanation without limiting the scope of the present disclosure as claimed.

BRIEF DESCRIPTION OF THE DRAWINGS

The accompanying drawings, which are included to provide a further understanding of the present disclosure, are incorporated in and constitute a part of this specification, illustrate aspects of the present disclosure and together with the detailed description serve to explain the principles of the present disclosure. No attempt is made to show structural details of the present disclosure in more detail than may be necessary for a fundamental understanding of the present disclosure and the various ways in which it may be practiced. In the drawings.

DETAILED DESCRIPTION OF THE PRESENT DISCLOSURE

Figure 1:
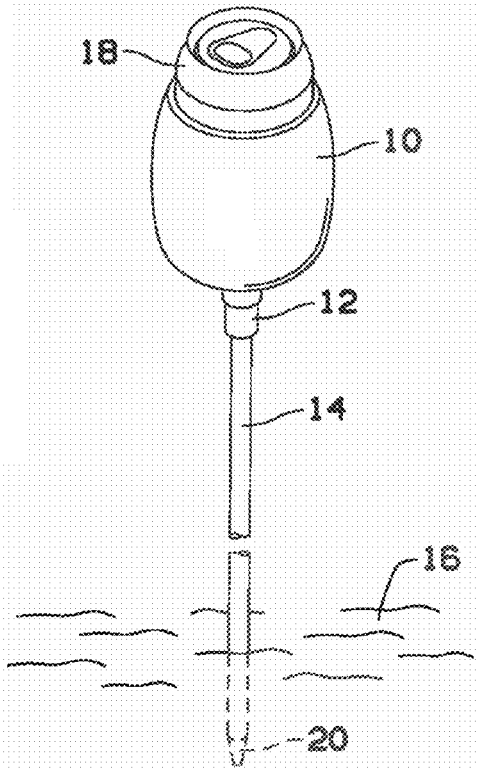
FIG. 1 shows a beverage holder, according to an aspect of the present disclosure.

The aspects of the present disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the present disclosure. The examples used herein are intended merely to facilitate an understanding of ways in which the present disclosure may be practiced and to further enable those of skill in the art to practice the aspects of the present disclosure. Accordingly, the examples and aspects herein should not be construed as limiting the scope of the present disclosure, which is defined solely by the appended claims and applicable law. Moreover, it is noted that like reference numerals represent similar parts throughout the drawings.

FIG. 1 shows a beverage holder 10, according to an aspect of the present disclosure. The holder may be sized and shaped to receive an aluminum can 18 of standard or common dimensions. For example, the aluminum can 18 may be purchased at a grocery store or other business and may contain soda, beer, fruit juice, or other beverage. The holder 10 may be made from aluminum, fiber glass, polystyrene, plastic, or other lightweight material. In particular, the holder 10 may be manufactured by a process known as metal spinning. The holder 10 may be protected with a reflective powder coated finish, or other anti-corrosion finish as determined to be suitable by one skilled in the art.

Figure 2:
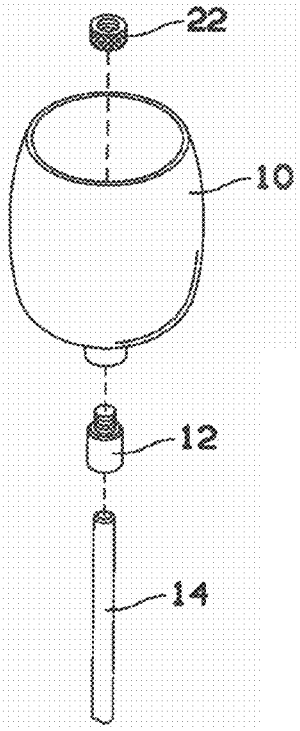
FIG. 2 shows an exploded view of the beverage holder of FIG. 1.

FIG. 2 shows an exploded view of the beverage holder of FIG. 1. The holder 10 may be connected to a stake 14 with a pointed tip 20. The pointed tip 20 may facilitate driving or implanting the stake 14 into the ground 16. The holder 10 may be connected to the stake 14 by a threaded boss 12. The boss 12 may be permanently or removably attached to the stake 14. Adhesive, glue, welding, or any other appropriate means may be used to affix the boss 12 to the stake 14.

Figure 3:
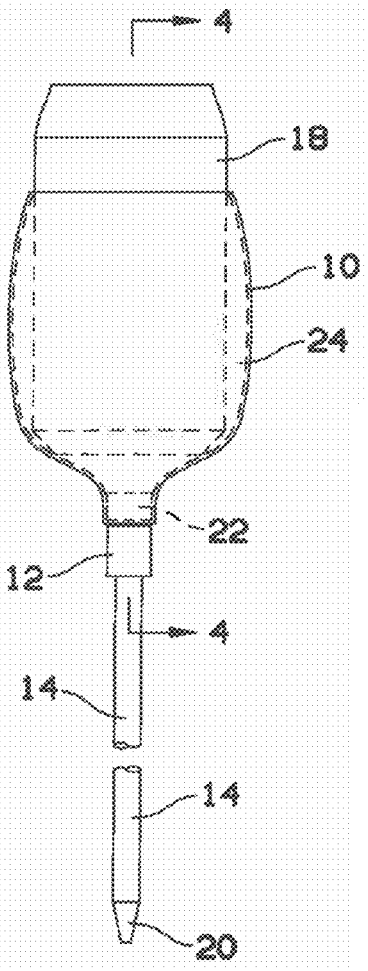
FIG. 3 shows a front view of the beverage holder of FIG. 1.
Figure 4:
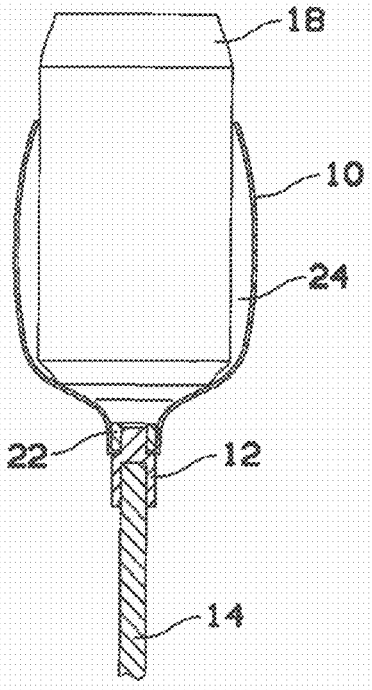
FIG. 4 shows a section view of the beverage holder taken along line 4-4 in FIG. 3.
Figure 5:
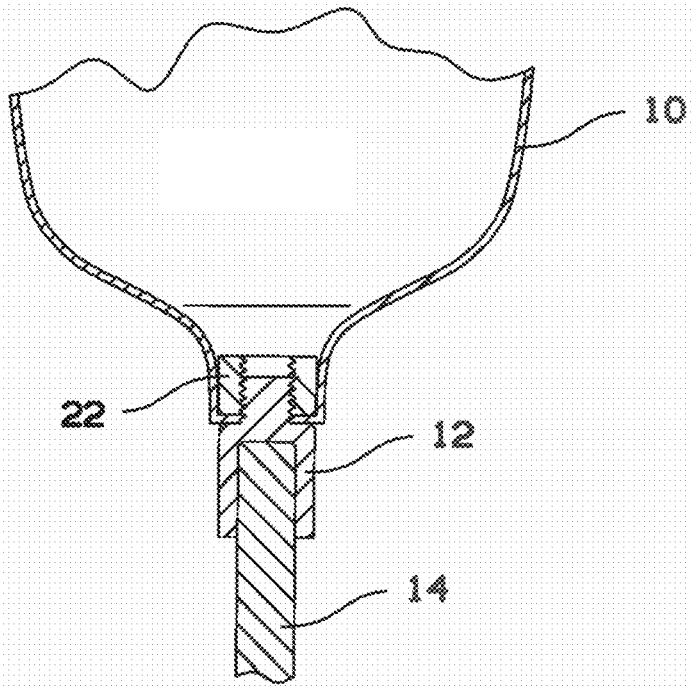
FIG. 5 shows an enlarged section view of a beverage holder.

FIG. 3 shows a front view of the beverage holder of FIG. 1, and FIG. 4 shows a section view of the beverage holder taken along line 4-4 in FIG. 3. FIG. 5 shows an enlarged section view of a beverage holder. A threaded insert 22 may be located at the bottom or base of the holder 10. The insert 22 may be permanently affixed to the holder 10 by the use of adhesive, glue, tape, welding, friction, or the like. The insert 22 may be configured to receive the threaded boss 12, thereby connecting the holder 10 to the stake 14. The holder 10 may be removed from the stake 14, e.g., for storing or transporting the device.

The holder 10, and its interior in particular, may be shaped to insulate the beverage can 18. The holder 10 may be sized so that the can 18 fits substantially or completely into the holder 10. In addition, the holder 10 may have minimal surface area in contact with the can 18. By substantially surrounding the can 18 while having minimal contact with it, the holder 10 may create an isolated pocket or gap of air 24 around the can 18. The air gap 24 serves to insulate the can 18.

For example, when a can 18 is placed in the holder 10, the holder may only contact the can 18 at two separate and discrete locations. The first contact location may be a circle formed by the top of the holder 10 and contacting the can 18 near the top of the can 18. The second contact location may be a circle formed around the base of the can 18. These contact points may be seen, e.g., in FIGS. 3 and 4. As a result, an insulating air gap 24 may be formed between the inside of the holder 10 and the can 18. The air gap 24 insulates the can 18, e.g., helping to keep a liquid in the can 18 cold while the can 18 is in the holder 10.

While the present disclosure has been described in terms of exemplary aspects, those skilled in the art will recognize that the present disclosure can be practiced with modifications in the spirit and scope of the appended claims. These examples given above are merely illustrative and are not meant to be an exhaustive list of all possible designs, aspects, applications or modifications of the present disclosure.

What is claimed is:

1. A system for holding and insulating a fluid, the system comprising:

a beverage container, being cylindrical in that it has a circular top and bottom connected with a side; wherein the beverage container is filled with the fluid;

a holder, having a holder bottom attached to a threaded insert and a holder side; wherein the holder side is extruded outward from the bottom and then extruded inward toward an aperture; wherein the holder is surrounding the bottom and most of the side of the beverage container, wherein the aperture is formed in the holder and configured to tightly engage the beverage container at an upper circumference around the side of the beverage container, trapping air below the upper circumference between the holder side and the side of the beverage container, a lower circumference around the side of the beverage container, holding a lower portion of the beverage container; wherein between the threaded insert and a bottom of the beverage container a frustoconical gap is formed below the lower circumference; and an insulating pocket of air between the upper circumference and the lower circumference wherein the insulating pocket of air operates to maintain a temperature of the fluid in the beverage container.

2. The device of claim 1, further comprising a stake having a first and second end, the first end configured to be mechanically secured to the holder and the second end configured to be a pointed end to be driven into the ground.

3. The device of claim 2, further comprising a threaded boss connected to the first end of the stake;

wherein the threaded insert configured to receive the threaded boss.

4. The device of claim 1, wherein the holder is formed from a material selected from the group of fiberglass, polystyrene or plastic.

5. The device of claim 1, wherein the holder is formed from aluminum.

* * * * *